US008850785B2

(12) United States Patent
Siejak et al.

(10) Patent No.: US 8,850,785 B2
(45) Date of Patent: Oct. 7, 2014

(54) BUOYANT ROPE

(75) Inventors: Volker Siejak, Duisburg (DE); Andreas Flachenecker, Essen (DE); Petra Gottmann, Gevelsberg (DE); Qiao Xiao, Erlenbach a. Main (DE)

(73) Assignee: PHP Fibers GmbH, Obernburg (DE)

( * ) Notice: Subject to any disclaimer, the term of this patent is extended or adjusted under 35 U.S.C. 154(b) by 62 days.

(21) Appl. No.: 13/806,590

(22) PCT Filed: May 20, 2011

(86) PCT No.: PCT/EP2011/058227
§ 371 (c)(1),
(2), (4) Date: Dec. 21, 2012

(87) PCT Pub. No.: WO2011/160905
PCT Pub. Date: Dec. 29, 2011

(65) Prior Publication Data

US 2013/0091822 A1 Apr. 18, 2013

(30) Foreign Application Priority Data

Jun. 21, 2010 (EP) ..... 10166618

(51) Int. Cl.
*D07B 1/20* (2006.01)

(52) U.S. Cl.
CPC ..... *D07B 1/20* (2013.01); *D07B 2205/2046* (2013.01); *D07B 2205/201* (2013.01); *D07B 2205/2039* (2013.01); *D07B 2205/20* (2013.01)
USPC ..... 57/236; 57/244

(58) Field of Classification Search
CPC ..... D07B 1/02; D07B 1/12; D07B 1/20; D07B 2201/2036; D07B 2201/2041; D07B 2201/2063; D07B 2205/2046
USPC ..... 57/236–251
See application file for complete search history.

(56) References Cited

U.S. PATENT DOCUMENTS

| | | | | | |
|---|---|---|---|---|---|
| 3,558,420 | A * | 1/1971 | Opfell | 428/398 |
| 3,745,061 | A * | 7/1973 | Champaneria et al. | 428/398 |
| 4,020,229 | A * | 4/1977 | Cox, Jr. | 428/372 |
| 4,548,866 | A * | 10/1985 | Cordova et al. | 428/398 |
| 4,559,884 | A * | 12/1985 | Stoldt et al. | 112/475.17 |
| 5,104,725 | A * | 4/1992 | Broaddus | 442/360 |
| 5,190,821 | A * | 3/1993 | Goodall et al. | 428/398 |
| 5,230,957 | A * | 7/1993 | Lin | 428/398 |
| 5,279,897 | A * | 1/1994 | Goodall et al. | 428/398 |
| 5,362,563 | A * | 11/1994 | Lin | 428/398 |
| 5,532,060 | A * | 7/1996 | Aneja et al. | 428/398 |
| 5,694,755 | A * | 12/1997 | Frøystad | 57/211 |
| 6,327,841 | B1 * | 12/2001 | Bertini et al. | 57/210 |
| 6,418,704 | B2 * | 7/2002 | Bertini et al. | 57/210 |
| 6,474,057 | B2 * | 11/2002 | Bertini et al. | 57/210 |
| 6,640,533 | B2 * | 11/2003 | Bertini et al. | 57/210 |
| 7,546,724 | B2 * | 6/2009 | Wang | 57/210 |
| 2002/0002815 | A1 * | 1/2002 | Bertini et al. | 57/216 |
| 2002/0050131 | A1 * | 5/2002 | Bertini et al. | 57/210 |
| 2002/0095929 | A1 * | 7/2002 | Bertini et al. | 57/210 |
| 2004/0182064 | A1 * | 9/2004 | Yahata et al. | 57/1 R |

FOREIGN PATENT DOCUMENTS

| | | | |
|---|---|---|---|
| EP | 0 666 364 | A2 | 8/1995 |
| EP | 2 130 969 | A2 | 12/2009 |
| JP | A-2000-303254 | | 10/2000 |
| JP | A-2003-055836 | | 2/2003 |
| WO | WO 2009/026215 | A1 | 2/2009 |

OTHER PUBLICATIONS

Jul. 21, 2011 International Search Report issued in International Application No. PCT/EP2011/058227.
Jul. 21, 2011 Written Opinion of the International Searching Authority issued in International Application No. PCT/EP2011/058227 (w/Translation).

* cited by examiner

*Primary Examiner* — Shaun R Hurley
(74) *Attorney, Agent, or Firm* — Oliff PLC

(57) ABSTRACT

A buoyant rope is presented consisting of at least two strands, wherein each strand comprises synthetic fibers, wherein the rope is characterized in that the synthetic fibers comprise a component A) and a component B), wherein A) is at least one monofilament and B) is at least one multifilament yarn, the filaments of which are hollow-fiber filaments.

10 Claims, No Drawings

BUOYANT ROPE

BACKGROUND

The invention relates to a buoyant rope, i.e., a rope that floats on the water.

Ropes of this type are known. JP 2000-303254 and JP 2003-055836 each describe a buoyant rope made of hollow fibers made from a thermoplastic polymer, e.g. made from nylon 6, with a proportion of hollow volume to fiber volume of 10 to 35%, wherein the hollow fibers have at least two lumina. WO 2009/026215 describes a hybrid yarn made from one or more polyolefin fibers and one or more reinforcing fibers. The hybrid yarn can be used, among other things, for forming fibrous structures including braided ropes.

DETAILED DESCRIPTION OF EMBODIMENTS

Therefore, it is the object of the present invention to make a further buoyant rope available.

This object is achieved by a buoyant rope consisting of at least two strands, wherein each strand comprises synthetic fibers, and preferably each strand consists of synthetic fibers, wherein the rope is characterized in that the synthetic fibers comprise a component A) and a component B), wherein A) is at least one monofilament and B) is at least one multifilament yarn, the filaments of which are hollow-fiber filaments.

It was surprisingly found that, because the synthetic fibers in each strand of the inventive rope consist of a component A) and a component B), wherein A) is at least one monofilament and B) is at least one multifilament yarn, the filaments of which are hollow fibers, buoyant ropes can be produced which, in comparison with ropes that consist of up to 100% multifilament yarn, have a significantly more stable cable cross-sectional shape. The significantly more stable cable cross-sectional shape of the inventive buoyant rope has as a consequence that the inventive buoyant rope, in comparison to a buoyant rope without component A), has the following technical advantages:

- A reliable uniform winding by winches or by windlasses on ships is possible and the maximum diameter of the winch is not exceeded at full winding. Folding-under of cable segments during winding up (e.g. on winches) is either completely prevented or at least significantly reduced. The prevention or at least significant reduction of the folding-under is an essential prerequisite for a uniform run-out of the cable from the winch, by which means the risk of injury to people due to abrupt release of folded-under cable segments is prevented or at least significantly reduced.
- The frictional resistance during feeding of the rope over guide elements, such as fairleads, is reduced by the comparatively small contact surface area of the rope on the guide elements, by which means the core material surrounded by the monofilament is protected from damage due to wear.

Detailed Description of Embodiments

In a preferred embodiment of the inventive buoyant rope, the rope consists of 3 to 36 strands.

In a particularly preferred embodiment of the inventive buoyant rope, the rope consists of 6 to 18 strands.

In a further preferred embodiment of the inventive buoyant rope, the rope contains 2 to 648 monofilaments.

In a particularly preferred embodiment of the inventive buoyant rope, the rope contains 3 to 54 monofilaments.

If the inventive buoyant rope consists for example of 36 strands, each of the 36 strands can contain 18 monofilaments.

If the inventive buoyant rope consists for example of 6 strands, each of the 6 strands can contain 9 monofilaments.

In the inventive buoyant rope, the component A) and the component B) form a weight ratio A):B), wherein A):B) lies preferably in the range from 20:80 to 80:20, particularly preferably in the range from 30:70 to 70:30, and more particularly preferably in the range from 35:65 to 65:35.

The at least one monofilament of the component A) of the inventive buoyant rope can consist basically of any material that is suitable for the production of a monofilament. The at least one monofilament consists preferably of a fiber-forming polymer which is selected from the group of polyamides, polyesters, polyethylenes, polypropylenes, polylactic acids and polyphenylene sulfides.

The hollow-fiber filaments of the at least one multifilament yarn of the component B) of the inventive buoyant rope can consist basically of any material that is suitable for the production of hollow-fiber filaments. The hollow-fiber filaments of the at least one multifilament yarn consist preferably of a fiber-forming polymer which is selected from the group of polyamides, particularly preferably from the group of aliphatic polyamides (PA), wherein more particularly preferably a polyamide 6 (PA 6), a polyamide 6.6 (PA 6.6), or a polyamide 4.6 (PA 4.6) is selected as the aliphatic polyamide.

At least one monofilament is used for the inventive buoyant rope, which monofilament preferably has a diameter in the range from 0.5 mm to 7.0 mm, particularly preferably in the range from 1 mm to 6.0 mm, and more particularly preferably in the range from 1.6 mm to 5.0 mm.

Particularly suited as a monofilament is the monofilament available from Perlon-Monofil GmbH (Germany) under the trade name Atlas® Monofilament Type X 400 (diameter e.g. 4 mm).

The at least one monofilament used for the production of the inventive buoyant rope preferably has a breaking tenacity in the range from 30 cN/tex to 70 cNltex, particularly preferably in the range from 35 cN/tex to 65 cN/tex, and more particularly preferably in the range from 40 cN/tex to 57 cN/tex.

In a further preferred embodiment of the inventive buoyant rope, the at least one monofilament used for the production of the rope has an elongation at rupture in the range from 10% to 30%, particularly preferably in the range from 12% to 28%, and more particularly preferably in the range from 14% to 24%.

The hollow-fiber filaments used for the production of the inventive buoyant rope preferably have a breaking tenacity in the range from 43 cN/tex to 80 cNltex, particularly preferably in the range from 53 cN/tex to 70 cN/tex, and more particularly preferably in the range from 57 cN/tex to 66 cN/tex.

The hollow-fiber filaments used for the production of the inventive buoyant rope preferably have an elongation at rupture in the range from 9% to 35%, particularly preferably in the range from 14% to 30%, and more particularly preferably in the range from 19% to 25%.

Particularly suited as hollow-fiber filaments are the hollow-fiber multifilaments available from Polyamide High Performance GmbH (Germany) under the trade name Enkalon® 580 T.

In a preferred embodiment of the inventive buoyant rope, the hollow-fiber filaments have a lumen cross-sectional area proportion relative to the total cross-sectional area in the range from 5 to 35%, particularly preferably in the range from 10 to 30%, and more particularly preferably in the range from 15 to 28%.

In a further preferred embodiment of the inventive buoyant rope, the multifilament yarn consists of 2 to 840 hollow fibers, particularly preferably 70 to 350 hollow fibers, and more particularly preferably 120 to 300 hollow fibers.

In a further preferred embodiment of the inventive buoyant rope, the rope contains, in addition to the at least one monofilament of the component A) and the at least one multifilament yarn B), a component C), which consists of filler yarns, i.e. yarns, the diameter of which is selected such that the yarns fill in the interstices formed by the at least one monofilament and the at least one multifilament yarn. The filler yarns preferably consist of a multifilament yarn, the filaments of which are e.g. fibers, preferably hollow fibers, which are preferably spun from a polyamide and particularly preferably from an aliphatic polyamide such as polyamide 6 (PA 6), polyamide 6.6 (PA 6.6), or polyamide 4.6 (PA 4.6). Of the previously mentioned polyamides, polyamide 6 (PA 6) and polyamide 6.6 (PA 6.6) are more particularly preferred.

In a preferred embodiment, the inventive buoyant rope consists of 6 strands, wherein each strand consists of 9 monofilaments made from polyamide 6 (PA 6) having a diameter in the range from 3 mm to 4.75 mm and multifilament yarns, each made from 150 to 300 hollow fibers made from polyamide 6 (PA 6), each hollow fiber has a lumen cross-sectional area proportion in the range from 16% to 35% relative to the total cross-sectional area, and the rope has a weight and the weight proportion of the multifilament yarns is 65% relative to the rope weight.

The invention claimed is:

1. A buoyant rope including at least two strands, wherein each strand comprises synthetic fibers;

the synthetic fibers comprise a component A) and a component B), the component A) is at least one monofilament, wherein the at least one monofilament is not hollow and has a diameter in the range from 0.5 mm to 7.0 mm, and the component B) is at least one multifilament yarn, the filaments of which are hollow-fiber filaments.

2. The buoyant rope according to claim 1, wherein the weight ratio of the component A) to the component B) is in the range from 20:80 to 80:20.

3. The buoyant rope according to claim 1, wherein the at least one monofilament consists of a fiber-forming polymer that is selected from the group consisting of polyamides, polyesters, polyethylenes, polypropylenes, polylactic acids, and polyphenylene sulfides.

4. The buoyant rope according to claim 1, wherein the hollow-fiber filaments of the multifilament yam consist of a fiber-forming polymer that is selected from the group consisting of polyamides.

5. The buoyant rope according to claim 1, wherein the at least one monofilament has an elongation at rupture in the range from 10% to 30%.

6. The buoyant rope according to claim 1, wherein the hollow-fiber filaments have a breaking tenacity in the range from 43 cN/tex to 80 cN/tex.

7. The buoyant rope according to claim 1, wherein the hollow-fiber filaments have an elongation at rupture in the range from 9% to 35%.

8. The buoyant rope according to claim 1, wherein the hollow-fiber filaments have a lumen cross-sectional area proportion in the range from 5 to 35% relative to the total cross-sectional area.

9. The buoyant rope according to claim 1, wherein the at least one multifilament yam consists of hollow fibers, and the at least one multifilament yarn contains 2 to 840 hollow fibers.

10. The buoyant rope according to claim 1, wherein the rope includes 6 strands, each strand consists of 9 monofilaments made from polyamide 6 (PA 6) having a diameter in the range from 3 mm to 4.75 mm, and multifilament yarns, each made from 150 to 300 hollow fibers made from polyamide 6 (PA 6), each hollow fiber has a lumen cross-sectional area proportion in the range from 16% to 35% relative to the total cross-sectional area, and the weight proportion of the multifilament yams is 65% relative to the rope weight.

* * * * *

UNITED STATES PATENT AND TRADEMARK OFFICE

CERTIFICATE OF CORRECTION

PATENT NO. : 8,850,785 B2
APPLICATION NO. : 13/806590
DATED : October 7, 2014
INVENTOR(S) : Volker Siejak et al.

It is certified that error appears in the above-identified patent and that said Letters Patent is hereby corrected as shown below:

IN THE CLAIMS

In Col. 4, line 7, “yam” should be ---yarn---.

In Col. 4, line 25, “yam” should be ---yarn---.

In Col. 4, line 40, “yams” should be ---yarns---.

Signed and Sealed this
Sixth Day of January, 2015

Michelle K. Lee

Michelle K. Lee
*Deputy Director of the United States Patent and Trademark Office*